US006135655A

United States Patent [19]

Magirl

[11] Patent Number: 6,135,655

[45] Date of Patent: Oct. 24, 2000

[54] MULTIPIXEL DOTS IN MONOCHROME DROP-ON-DEMAND PRINTING

[75] Inventor: Christopher S. Magirl, San Diego, Calif.

[73] Assignee: Hewlett-Packard Company, Palo Alto, Calif.

[21] Appl. No.: 08/950,198

[22] Filed: Oct. 14, 1997

[51] Int. Cl.[7] ..... B41J 2/30

[52] U.S. Cl. ..... 400/120.07; 400/120.09

[58] Field of Search ..... 347/15, 5, 10, 347/188; 400/62, 75, 76, 120.07, 120.09, 120.1, 120.11, 124.02; 358/1.2, 1.8, 1.9

[56] References Cited

U.S. PATENT DOCUMENTS

| | | | |
|---|---|---|---|
| 4,621,273 | 11/1986 | Anderson | 346/140 |
| 4,680,645 | 7/1987 | Dispoto et al. | 358/298 |
| 4,746,935 | 5/1988 | Allen | 346/140 |
| 4,930,018 | 5/1990 | Chan et al. | 358/298 |
| 4,963,882 | 10/1990 | Hickman | 346/1.1 |
| 4,965,593 | 10/1990 | Hickman | 346/140 |
| 4,967,203 | 10/1990 | Doan et al. | 346/1.1 |
| 4,999,646 | 3/1991 | Strask | 346/11 |
| 5,012,257 | 4/1991 | Lowe et al. | 346/1.1 |
| 5,031,050 | 7/1991 | Chan | 358/298 |
| 5,111,302 | 5/1992 | Chan et al. | 358/298 |
| 5,140,432 | 8/1992 | Chan | 358/298 |
| 5,392,061 | 2/1995 | Vondran, Jr. | 347/252 |
| 5,617,123 | 4/1997 | Takaoka et al. | 347/15 |
| 5,764,252 | 6/1998 | Burr et al. | 347/20 |

OTHER PUBLICATIONS

Jaime H. Bohorquez et al, "Laser–Comparable Inkjet Text Printing", Hewlett–Packard Journal, Feb., pp. 9–17 (1994).

Carol Beamer et al, "Development of the HP DeskJet 1200C Print Cartridge Platform", Hewlett–Packard Journal, Feb., pp. 46–54, (1994).

*Primary Examiner*—John S. Hilten

[57] ABSTRACT

Large, overlapping "mega-dots", placed on small, high resolution pixel locations, are used in high quality monochrome imaging to preserve information to the micro, or pixel, level, thus avoiding the need to use micro-sized droplets. By using multiple passes and multiple pens with different levels of gray ink, one may build a single monochrome 600 dpi (dots per inch) pixel with the composite gray of those droplets at that pixel location as well as the neighboring locations. With careful print modes and multiple passes, one can produce several levels of gray at a particular pixel location. The biggest advantage of using multipixel dots is that the sensitivity to trajectory errors is significantly reduced. For example, a dot that is $1/150^{th}$ inch diameter is almost indifferent to a $1/1200^{th}$ trajectory error. Even a relatively large $1/600^{th}$ inch error has little impact on the large $1/150^{th}$ dot (25% error). In reducing the sensitivity to trajectory errors, overall imaging errors, such as banding, can be reduced, and overall image quality enhanced. Optimally, the large dots have a diameter that is about three to five times the pixel size, providing an overlap of three to five dots, respectively.

5 Claims, 1 Drawing Sheet

MULTIPIXEL DOTS IN MONOCHROME DROP-ON-DEMAND PRINTING

TECHNICAL FIELD

The present invention relates generally to drop-on-demand ink-jet printing, and, more particularly, to monochrome ink-jet printing, using large dot sizes of print to improve image quality.

BACKGROUND ART

Thermal ink-jet printing has traditionally targeted office and home printing applications, as well as CAD plotting markets, where customers demand crisp, clean lines and text. Small, precise dots have traditionally been the goal for design engineers. However, in producing smaller dots and placing them on the media with higher resolution (600 dpi and beyond), such ink-jet designs are susceptible to imaging artifacts, such as banding, caused by droplet trajectory errors. Images produced with these ultra small dots are sensitive to horizontal and vertical axis directionality errors. For example, a dot that is roughly $1/600^{th}$ inch in diameter can cause objectionable artifacts with even a $1/1200^{th}$ inch trajectory error (roughly 50% error). Nonetheless, small dots are one of the better ways to image color. However, there are developments using thermal ink-jet (TIJ) technology in monochrome imaging applications, including black and white photography, monochrome graphic arts, and medical imaging. When producing monochrome images, ultra small droplets may not be the only path to acceptable images. Moreover, many of these monochrome imaging applications do not have the need for crisp text and sharp lines, further mitigating the dependence on small drops.

Halftoning small dots is one way to produce monochrome images (e.g., newspapers, laser printers, and the like), but the images lose much information, especially on the micro level. With TIJ technology, one can use multiple passes and multiple levels of gray placed on the media with a high precision and still preserve much information even on the micro level. Individual pixels could be of one several thousand different shades of gray. Unfortunately, using relatively small dots, TIJ is still susceptible to trajectory errors that lead to imaging artifacts. An organization designing and manufacturing TIJ monochrome printers could invest significant resources to control small dot trajectory errors and achieve acceptable image quality. In contrast, it would be desirable to develop a printing scheme that imaged with the existing trajectory errors without the deleterious effects of those trajectory errors.

DISCLOSURE OF INVENTION

In accordance with the present invention, large, overlapping "mega-dots", placed on small, high resolution pixel locations, are used in high quality monochrome imaging to preserve information to the micro level, thus avoiding the need to use micro-sized droplets. By using multiple passes and multiple shades of gray ink, including black, from different pens, one may build the shade of a single 600 dpi (dots per inch) pixel with the composite gray of those droplets at that pixel location as well as the neighboring locations. With careful print modes and multiple passes, one can produce several levels of gray at a particular pixel location.

The method of the present invention comprises printing large dots on the print medium such that there is an overlap of more than two dots along both axes, wherein each individual large dot is much larger than the pixel size, whereby the large dots of ink are smooth and bleed and blend into each other.

The biggest advantage of using multipixel dots is that the sensitivity to trajectory errors is significantly reduced. For example, a dot that is $1/150^{th}$ inch diameter is almost indifferent to a $1/1200^{th}$ trajectory error. Even a relatively large $1/600^{th}$ inch error has little impact on the large $1/150^{th}$ dot (25% error). In reducing the sensitivity to trajectory errors, overall imaging errors, such as banding, can be reduced.

While the technique of the present invention may tend to blur text and fine lines placed in a light background, there are applications that do not typically image this high frequency information (e.g., monochrome photography and graphic arts and medical imaging), which are benefited by the teachings of the invention.

BEST MODES FOR CARRYING OUT THE INVENTION

Figure 1:
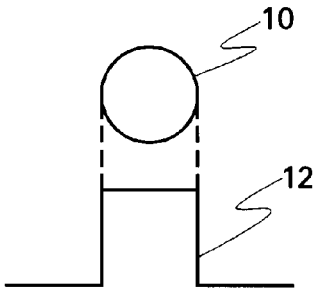
FIG. 1 (PRIOR ART)
FIG. 1 depicts a dot of the prior art and its resulting profile on coordinates of optical density and distance.

Turning now to the Figures, FIG. 1 shows a dot 10 and its associated cross-sectional absorption profile 12 (optical density as a function of distance across the dot). It is seen that the profile 12 is similar to a square wave.

Figure 2:
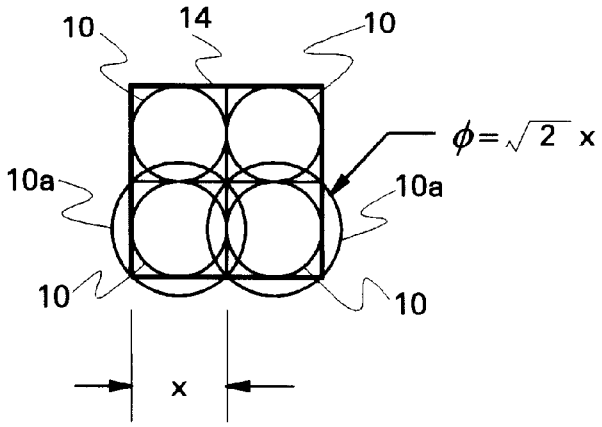
FIG. 2 (PRIOR ART)
FIG. 2 depicts the placement of the extent of dot overlap of the prior art to cover a pixel to the extent possible.

As an example, as applied to Hewlett-Packard's DesignJet® 750 printer, the current thermal ink-jet (TIJ) approach to ensure proper area fill for a 600 dpi dot 10 is to overlap the dots by an amount equal to $\sqrt{2}$ times the dot size to cover a pixel 14 to the extent possible FIG. 2 depicts four such dots 10 in the pixel 14. The dot size x is 42 $\mu$m of the dot 10. Overlapping the dots by an increase of $\sqrt{2}$ x, as shown at 10*a*, provides a dot size of nearly 60 $\mu$m.

But, it must be remembered that the foregoing TIJ considerations were all developed for office/home/text/CAD crisp markets, where it is very important to produce quality text and crisp lines.

Figure 3A:
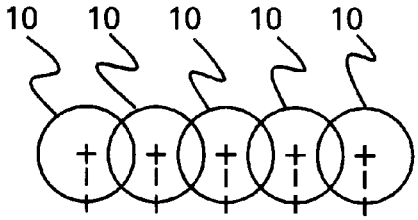
FIG. 3A (PRIOR ART)
FIG. 3*a* depicts a row of dots of the prior art, showing the centers of each dot.
Figure 3B:
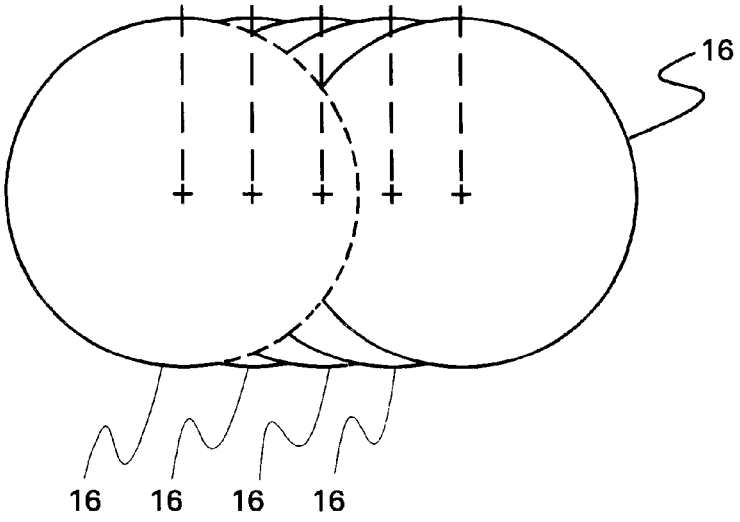
FIG. 3*b* depicts a row of dots of the present invention, also showing the centers of each dot, which are identical to the centers of the dots of FIG. 3*a*, but with much larger dots.

However, there are other markets in which the foregoing considerations are not critical. For example, with the current blurry medical imaging, one goal to strive for is to make it very difficult for anyone to see an individual dot on the print medium within the image itself. All the shades of gray produced on the print medium should be smooth and bleed and blend into each other. One way to achieve this blending is to make each individual dot very much larger than traditional dots and then over-lap these large dots. This approach is depicted in FIGS. 3*a* and 3*b*, which show dots 10 of the prior art (FIG. 3*a*) and dots 16 of the present invention (FIG. 3*b*), both on the same centers, denoted "+". The dots 16 of the present invention are three to five times the size of the dots 10 of the prior art, and thus considerable overlap of the dots is evident. Specifically, maintaining the pixel size while increasing the dot size to three to five times the pixel size results in an overlap of dots, along both vertical and horizontal axes, of three to five dots.

Large dots 16 provide the ability to hide defects and errors in dot placement within the large dots themselves. If done properly, the large dots 16 give smooth contours and transitions between individual dots. In providing the proper amount of dye flux in any particular pixel location, one would simply want to adjust the amount of dye in the dots placed on the target pixel location as well as the appropriate neighboring pixel locations. The distance of influence of neighboring dots is governed by the size of the dots themselves. Optimal dot size is roughly three to five times greater than the pixel grid.

The amount of overlap of the large dots is quite extensive, compared with earlier prior art dot sizes. Such earlier prior art dot sizes may have been in the same range as the dot sizes disclosed herein. However, the overlap of such large prior art dots was essentially the same as present prior art dot sizes, namely, a slight overlap of two adjacent dots (along each axis), such as shown in FIG. 2. The overlap of the large dots of the present invention, however, is considerably more extensive, and ranges from three to five dots (along one axis). The same amount of overlap also occurs along the orthogonal axis.

The foregoing considerations may advantageously be employed in printers of other DPI dimensions, using the extensive overlap of three to five dots (along each axis).

The biggest advantage of using the large dots 16 of the present invention is that the sensitivity to trajectory errors is significantly reduced. For example, a dot that is $1/150^{th}$ inch diameter is almost indifferent to a $1/1200^{th}$ trajectory error. Even a relatively large $1/600^{th}$ inch error has little impact on the large $1/150^{th}$ dot (25% error). In reducing the sensitivity to trajectory errors, overall imaging errors, such as banding, are reduced.

In past TIJ products, designers have been concerned with maintaining crisp text and lines, and dot development has followed with small round sharp dots. But in extending TIJ technology to certain monochrome imaging markets, there is no need to have crisp text. Therefore, smooth transitions between dots and smooth dots themselves are more desired. By placing large dots down on the media with overlap and shingling, it becomes possible to blend the contours and textures of the image together. However, the placement accuracy of 600 dpi pens is still maintained. Ultimately, a known amount of black dye (which leads to gray) can still be placed in a single 600 dpi location. The resolution and levels of gray remain the same. Rather, those sharp contrasts of individual dots within the media are simply eliminated. In turn, overall effects of banding and other dot related artifacts disappear.

Industrial Applicability

The method of printing high quality images disclosed herein is expected to find use in ink-jet printing, particularly in digital imaging applications.

Thus, there has been disclosed a method for imaging high quality images with smooth transitions between dots. It will be readily apparent to those skilled in this art that various changes and modifications of an obvious nature may be made, and all such changes and modifications are considered to fall within the scope of the appended claims.

What is claimed is:

1. A method of printing dots of ink on a print medium from a printer having a pixel size defined in terms of dots per inch, said print medium having a horizontal axis and a vertical axis, said method comprising printing large dots on said print medium such that there is an overlap of more than two dots along both axes, wherein each individual large dot is about three to five times larger than said pixel size, yet said large dots have a center-to-center spacing that is substantially identical to that of said pixel size, thereby providing an overlap of three to five dots along each axis, whereby said large dots of ink are smooth and bleed and blend into each other and sensitivity to trajectory errors is reduced.

2. The method of claim 1 wherein said printer is provided with more than one pen, each containing a different shade of gray, including black, and is configured to make more than one printing pass so as to provide a composite gray at each pixel location, thereby permitting several levels of gray at a particular pixel location.

3. A method of reducing imaging errors in monochrome imaging ink-jet printing, said ink-jet printing comprising printing dots of ink on a print medium from a printer having a pixel size defined in terms of dots per inch, said print medium having a horizontal axis and a vertical axis, said method comprising printing large dots on said print medium such that there is an overlap of more than two dots along both axes, wherein each individual large dot is about three to five times larger than said pixel size, yet said large dots have a center-to-center spacing that is substantially identical to that of said pixel size, thereby providing an overlap of three to five dots along each said axis, whereby said large dots of ink are smooth and bleed and blend into each other.

4. The method of claim 3 wherein said printer is provided with more than one pen, each containing a different shade of gray, including black, and is configured to make more than one printing pass so as to provide a composite gray at each pixel location, thereby permitting several levels of gray at a particular pixel location.

5. The method claim 3 wherein said monochrome imaging is selected from the group consisting of black and white photography, monochrome graphic arts, and medical imaging.

* * * * *